US008631852B2

(12) United States Patent
Kennerknecht

(10) Patent No.: US 8,631,852 B2
(45) Date of Patent: Jan. 21, 2014

(54) INVESTMENT CASTINGS AND PROCESS

(76) Inventor: Steven Kennerknecht, Beaconsfield (CA)

( * ) Notice: Subject to any disclaimer, the term of this patent is extended or adjusted under 35 U.S.C. 154(b) by 0 days.

(21) Appl. No.: 13/157,719

(22) Filed: Jun. 10, 2011

(65) Prior Publication Data

US 2011/0303384 A1 Dec. 15, 2011

(51) Int. Cl.
*B22D 27/04* (2006.01)

(52) U.S. Cl.
USPC ..... 164/122.1; 164/348; 164/122.2

(58) Field of Classification Search
USPC ..... 164/122.1, 348, 122.2
See application file for complete search history.

(56) References Cited

U.S. PATENT DOCUMENTS

| | | | | |
|---|---|---|---|---|
| 3,287,769 | A * | 11/1966 | Hess et al. | 164/514 |
| 6,640,876 | B2 * | 11/2003 | Yajima et al. | 164/122.1 |
| 2003/0079855 | A1 * | 5/2003 | Graham | 164/122.1 |
| 2009/0014187 | A1 * | 1/2009 | Wagner | 169/46 |

FOREIGN PATENT DOCUMENTS

JP 59021449 A * 2/1984

* cited by examiner

*Primary Examiner* — Kevin P Kerns
*Assistant Examiner* — Kevin E Yoon
(74) *Attorney, Agent, or Firm* — The Farrell Law Firm, P.C.

(57) ABSTRACT

An investment casting process is provided in which a molten aluminum metal is cast into a refractory mold and thereafter cooled to solidify the metal in the mold. The improvement includes the step of cooling the mold and solidifying the metal therein which is carried out by placing the mold in a chamber adapted to retain a liquid. The mold is mounted in a stationary condition in the chamber. A coolant liquid is introduced into the chamber to immerse the mold in the liquid while maintaining the mold in a stationary condition.

8 Claims, 2 Drawing Sheets

INVESTMENT CASTINGS AND PROCESS

BACKGROUND OF THE INVENTION

1. Field of the Invention

This invention relates to metal casting of alloys using the investment casting process. In particular it relates to the rapid solidification of aluminum alloy castings.

2. Description of Related Art

Investment or "lost wax" castings are increasingly specified for demanding applications favouring a combination of tight tolerances, good surface finish, thin walls and high integrity. Integrity is characterized by an absence of voids or macro defects, and possessing predictable and elevated levels of mechanical properties. In order to achieve high integrity castings capable of meeting the uppermost level of mechanical properties on a statistical basis, special techniques are required to solidify the casting inside the precision ceramic mold. Considerable prior art describes controlled solidification of castings in order to improve final part performance, none of which are ideal for the investment casting process. The invention covers a unique casting solidification method.

Mechanical properties (strength, ductility, fatigue resistance, etc.) of cast alloys are often inferior over similar wrought alloys, due to an associated coarse microstructure (large grainsize or dendrite arm spacing) of the casting, resulting from slow solidification. The relatively insulating investment casting shell mold combined with superheated alloy being poured into the pre-heated mold results in only moderate cooling rates. Accelerating the speed of casting solidification will improve mechanical properties of many alloys dramatically. Cast aluminum-silicon-magnesium alloys for example exhibit superior static and dynamic mechanical properties, and an associated reduction in data scatter, when solidified in a rapid controlled manner. Solidification front advancement in a controlled manner is essential in avoiding shrinkage defects which would otherwise lower mechanical properties of the component.

Extraction of superheat from a solidifying investment casting necessitates the use of chills adjacent to the casting surface, or use of a cooling medium acting on the exterior surface of the thin ceramic shell mold. Many processes have been devised to cool the exterior of the investment casting shell mold, following filling of the mold with hot metal alloy.

U.S. Pat. No. 6,308,767 (December 1999) by Hugo, Betz and Mayer describes a process whereby an investment casting is directionally solidified in a liquid metal bath inside a vessel. European Patent 0,571,703, B1 (November 1996) by Folkers, Nicolai, Rodehuser, Steinrucken, and Henneke describes a process whereby a cast mold is lowered into a bath of water/organic liquid mixture inside a vessel. U.S. Pat. No. 4,108,236 (August 1978) by Salkeld describes the use of a floating baffle to separate the cast ceramic shell from the liquid metal bath quenchant for directional solidification of the casting. U.S. Pat. No. 3,915,761 (October 1975) by Tschinkel, Giamei and Kear describes a process of lowering a cast mold into a cooling bath in order to achieve directional solidification of the casting. U.S. Pat. No. 6,622,744 (September 2003) describes a process of lowering a cast mold into a bath of cooling oil to extract heat from the mold.

Prior art techniques involve for example use of liquid metal heat transfer media for cooling of the shell mold, which in the case of light alloy castings such as aluminum would result in a net inward crushing pressure on the ceramic shell mold and likely failure of large cast articles immersed to great depths. Although heavier and stronger shell molds could be fashioned to resist this inward crushing pressure of the liquid metal bath, heavier shell thickness would reduce conductive heat transfer from the solidifying casting, and make less effective the described process. Prior art techniques using non-metallic quenches, also employ cumbersome manipulation and vertical movement of the mold during solidification thereby risking breakage of the casting, or disturbance of the solidification front. Prior art techniques also expose the solidifying casting to the ambient air environment which risks hydrogen (humidity) absorption into the liquid metal and subsequent generation of porosity into the casting.

SUMMARY OF THE INVENTION

The present invention has been made to address at least the above problems and/or disadvantages and to provide at least the advantages below.

In a preferred embodiment of the present invention, there is provided an investment casting process in which a molten aluminum metal is cast into a refractory mold and thereafter cooled to solidify the metal in the mold, the improvement providing for cooling of the mold and solidification of the metal therein being carried out by placing the mold in a chamber adapted to retain a liquid, mounting the mold in a stationary condition in the chamber, and introducing a coolant liquid into the chamber to immerse the mold in the liquid while the mold is maintained in a stationary condition. In a preferred embodiment, the aforementioned chamber comprises a double walled chamber which will function both as a fluid reservoir as well as a technique for keeping the chamber walls cool.

In a further preferred embodiment, the metal in the mold is cooled under pressurized conditions.

In yet another preferred embodiment, the process includes utilizing elevated static gas pressure to suppress gas formation while the mold is cooling and to reduce volatilization or boiling of the liquid during the cooling process.

Another preferred embodiment of the present invention provides for the liquid to be agitated at a predetermined rate, and wherein the coolant liquid is introduced into the chamber at a predetermined rate to achieve a desired heat transfer rate and directional solidification of the metal in the mold.

In yet another preferred embodiment of the present invention, there is provided a controlled solidification casting system which comprises a cooling chamber adapted to receive and retain a stationary mold having molten aluminum metal therein; means for introducing into the chamber a coolant liquid medium and for filling the chamber with the liquid to thereby immerse the mold in the cooling liquid while the mold is stationary, and means for removing the coolant liquid from the chamber when desired.

The system of the present invention provides the further preferred embodiment wherein the cooling chamber includes means for introducing into the chamber a pressurized gas.

In yet another preferred embodiment of the present invention, the system provides for the chamber to include a rapid lock door.

In another preferred embodiment of the present invention, the system includes means for providing agitation to the coolant liquid, and means for controlling the flow of coolant liquid into the chamber.

In the above process, and by way of example, the hot ceramic shell mold is filled with superheated metal alloy as is customary in the art. In general, the combination of elevated metal and shell temperature will enable the casting to remain liquid until it is placed into the described equipment. The cast shell is transported into the vessel, door closed and part placed under iso-tropic gas pressure during solidification, resulting in gas suppression in the casting, and a reduction or elimination of voids. Pressures of 30-200 psi are common and economical for gas reduction in castings, although other settings may be employed in practice. Inert gases such as argon or nitrogen are commonly employed to prevent oxidation of the quench media, although other gases may be used in practice. The hot ceramic mold filled with metal, is stationary in the vessel during the solidification and heat removal process, avoiding vibration or movements leading to potential shell failure. The casting solidifies by transferring heat from the cast alloy through the ceramic shell mold and into the heat transfer fluid. The choice of fluid is established to achieve thermal stability and high convective heat removal at processing temperatures. Typical fluids include heat treat quenching oils, silicon fluids, liquefied fats/waxes, liquefied stearic acid and other non-aqueous liquids. The speed of fluid agitation, as well as the level control to flood the mold are independently varied to achieve uniform heat removal from the mold and directional solidification of the casting. Rapid controlled heat extraction from the casting during the transition from liquid to solid, results in a fine cast microstructure and attendant high mechanical properties.

BRIEF DESCRIPTION OF THE DRAWINGS

Having thus generally described the invention, reference will now be made to the accompanying drawings illustrating preferred embodiments, and in which.

DETAILED DESCRIPTION OF EMBODIMENTS OF THE PRESENT INVENTION

Figure 1:
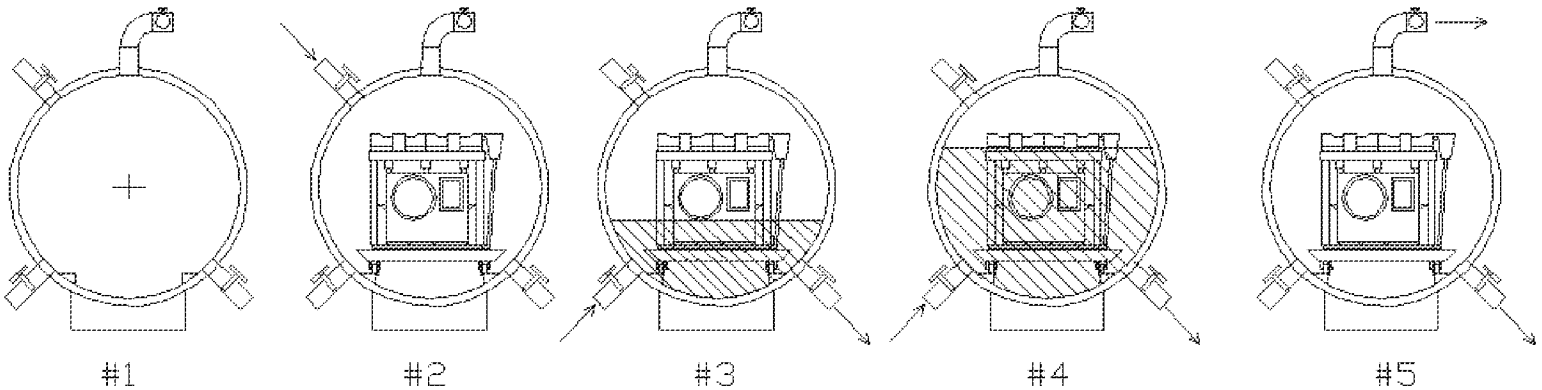
FIG. 1 is a schematic diagram illustrating a solidification process sequence for a mold which has been previously filled with liquid alloy, according to an embodiment of the present invention.

FIG. 1 depicts a schematic of the solidification process sequence, for a mold which has been previously filled with liquid alloy. A section view of a horizontal pressure vessel with quick lock door is shown. A cast mold is supported on a perforated tray/wagon which is rolled into and out of the vessel at the beginning and end of the cycle.

FIG. 1—step #1 depicts the empty vessel prior to receiving the mold. Step #2 shows the cast mold in the vessel, with vessel door closed, and (inert) gas pressure applied. Step #3 shows liquid heat exchange fluid being circulated inside the vessel. The differential flow of coolant into and out of the vessel will dictate the level rise. Forced convection of the fluid against the shell mold is achieved via mechanical stirring and/or removal/re-introduction of the fluid into the vessel from an external cooling and circulation system. Step #4 depicts later stages of the process whereby the coolant has risen in the vessel, to directionally solidify the casting. The rate of heat transfer fluid rise may be independently controlled depending on the metal alloy solidification characteristics. Too slow a fluid rise will result in the casting solidifying above the fluid bath, with a retarded cooling rate. Too fast a rise of the fluid will minimise the directional solidification of the casting and "auto feeding" effect of gates/risers located near the top of the mold. Step #5 depicts a solidified casting in the latter stages of processing. The casting must be completely immersed and solidified at the end of the cycle, although the uppermost gates/risers may remain; liquid, semi-solid, or solid. Once completed the vessel is depressurized, drained of heat transfer fluid, and casting removed.

Figure 2:
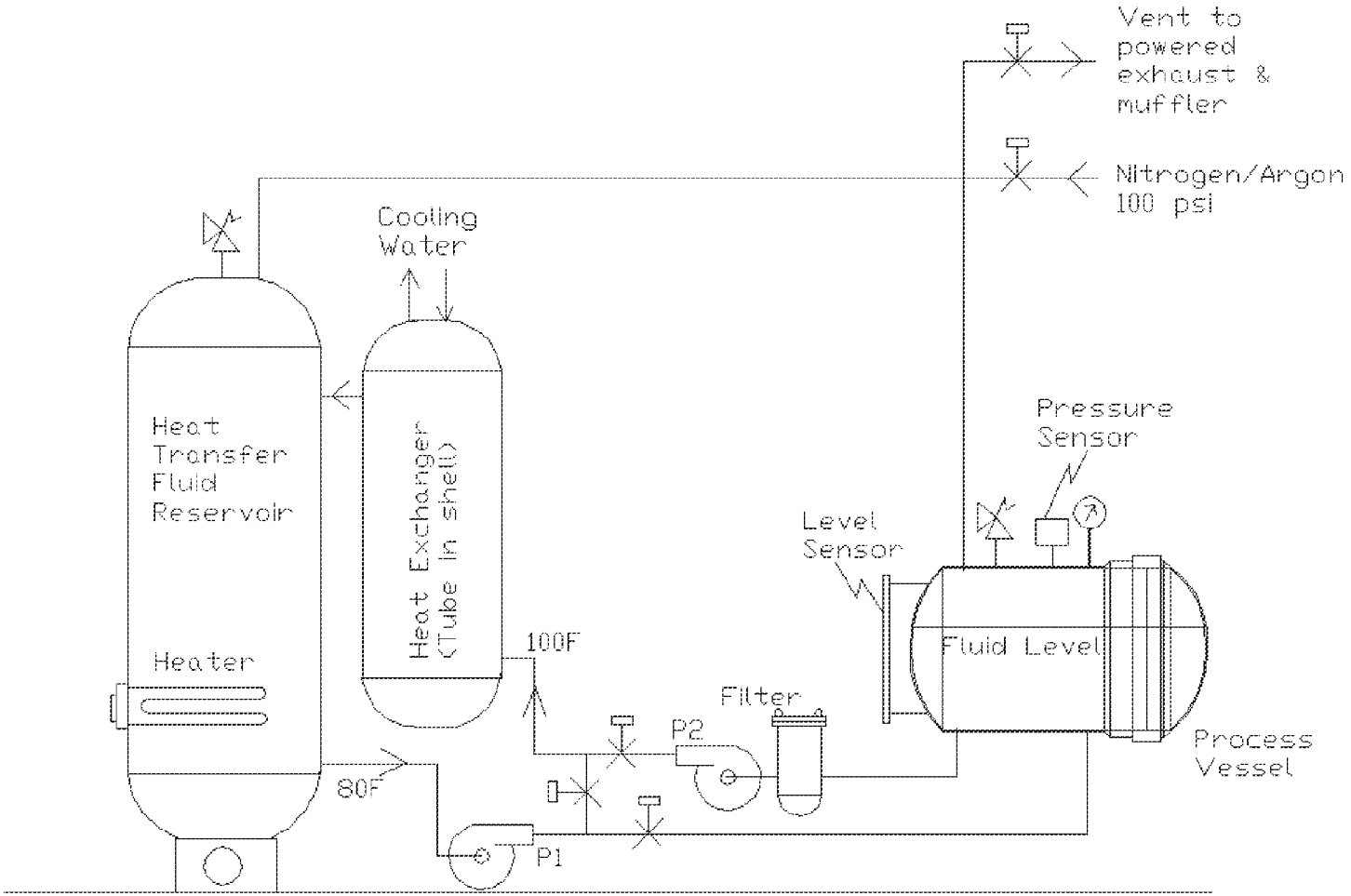
FIG. 2 is a schematic diagram illustrating a controlled solidification process equipment, according to an embodiment of the present invention.

FIG. 2 depicts a typical schematic for the controlled solidification process equipment. The schematic is provided in order to illustrate the various controls and elements which may be monitored during operation. Those individuals skilled in the art will find other variations of the process whereby particular elements may be internal or external to the processing vessel, and others added or deleted for convenience. As depicted, a reservoir of heat transfer fluid is warmed to operating temperature, and coolant pumped into the vessel. After cooling the cast mold, the fluid leaves the vessel and is pumped through a heat exchanger back into the fluid reservoir. Plumbing elements are arranged to independently circulate fluid in the vessel at desired intensity, as well as independently control fluid rise in the processing chamber.

Example 1

An investment casting mold is preheated to 1100 F and filled with liquid A357 aluminum alloy at 1320 F. The metal filled mold is transferred to the solidification chamber and door closed. The vessel is pressurized to 90 psi with nitrogen, after which polyalkalene glycol cooling liquid at 100 F is pumped into the chamber, immersing the mold. Superheat from the cast mold moves into the cooling fluid resulting in rapid solidification of the casting. The casting is removed from the chamber, cleaned, and heat treated to optimal mechanical properties noted below. For the known process, the investment casting was carried out using conventional techniques but without use of the cooling liquid being pumped into the chamber.

| | Known Process | Applicant's Process |
|---|---|---|
| Cooling Media | Air | PAG Glycol (BASF Pluriol SRF2) |
| Cast Dendrite Arm Spacing | 114 um. | 56 um. |
| Tensile (after heat treat) | 39,000 psi | 52,000 psi |
| Yield Strength (after heat treat) | 29,000 psi | 41,000 psi |
| Elongation (after heat treat) | 3.0% | 5.0% |

Example 2

An investment casting mold is preheated to 1100 F and filled with liquid A356 aluminum alloy at 1320 F. The metal filled mold is transferred to the solidification chamber and door closed. The vessel is pressurized to 100 psi with nitrogen, after which polyalkalene glycol cooling liquid at 100 F is pumped into the chamber. The cooling fluid submerges the mold at a quenching speed of 15 inches per minute. The 30" tall shell mold is completely quenched and submerged in cooling fluid after two minutes. Immersing the mold in a controlled fashion results in directional solidification and reduction of feeding gates needed to produce a sound casting. Superheat from the cast mold moves into the cooling fluid resulting in rapid solidification of the casting. The mold above the cooling bath remains hot and metal liquid. The casting is removed from the chamber, cleaned, and heat treated to optimal mechanical properties: For the known process, the investment casting was carried out using conventional techniques but without use of the cooling liquid being pumped into the chamber.

| | Known Process | Applicant's Process |
|---|---|---|
| Cooling Media | Air | PAG Glycol (BASF Pluriol SRF2) |
| Cast Dendrite Arm Spacing | 105 um. | 58 um. |
| Number of casting gates | 12 gates | 8 gates |
| Tensile (after heat treat) | 37,000 psi | 47,000 psi |
| Yield Strength (after heat treat) | 28,000 psi | 39,000 psi |
| Elongation (after heat treat) | 3.0% | 5.0% |

Example 3

An investment casting mold is preheated to 1100 F and filled with liquid A357 aluminum alloy at 1320 F. The metal filled mold is transferred to the solidification chamber and door closed. The vessel is pressurized to 90 psi with nitrogen, after which polyalkalene glycol cooling liquid at 100 F is pumped into the chamber, immersing the mold. Superheat from the cast mold moves into the cooling fluid resulting in rapid solidification of the casting. The cooling fluid is concurrently pumped from the chamber through a heat exchanger and re-introduced into the chamber to ensure the fluid temperature does not rise beyond allowable limits. This fluid pumping action also provides convective stirring of the fluid, ensuring uniform heat removal from the cast mold. The casting is removed from the chamber, cleaned, and heat treated to optimal mechanical properties:

| | Applicant's Process With Cooling & Stirring Run A | Applicant's Process with Static Coolant Run B |
|---|---|---|
| Cooling Media | PAG Glycol | PAG Glycol |
| Max coolant temperature | 110 F. | 160 F. |
| Stirring Speed in Chamber | 3 inch/second | none |
| Cast Dendrite Arm Spacing | 53 um. | 56 um. |
| Tensile (after heat treat) | 52,500 psi | 52,000 psi |
| Yield Strength (after heat treat) | 41,800 psi | 41,000 psi |
| Elongation (after heat treat) | 5.0% | 5.0% |

Example 4

An investment casting mold is preheated to 1100 F and filled with liquid A357 aluminum alloy at 1320 F. The metal filled mold is transferred to the solidification chamber and door closed. The vessel is pressurized to 90 psi with nitrogen, after which two types of liquid in different trials were pumped into the chamber, immersing the mold. Superheat from the cast mold moves into the cooling fluid resulting in rapid solidification of the casting. The casting is removed from the chamber, cleaned, and heat treated to optimal mechanical properties:

| | Applicant's Process Run A | Applicant's Process Run B |
|---|---|---|
| Cooling Media | Quench Oil (Quench K) | PAG Glycol (BASF Pluriol SRF-2) |
| Smoke evolution near surface | Yes | Minimal |
| Carbon buildup on vessel | Yes | Minimal |
| Carbon buildup on cast mold | Yes | Minimal |

-continued

| | Applicant's Process Run A | Applicant's Process Run B |
|---|---|---|
| Cast Dendrite Arm Spacing | 50 um. | 56 um. |
| Tensile (after heat treat) | 52,200 psi | 52,000 psi |
| Yield Strength (after heat treat) | 41,300 psi | 41,000 psi |
| Elongation (after heat treat) | 5.0% | 5.0% |

Example 5

An investment casting mold is preheated to 1100 F and filled with liquid A357 aluminum alloy at 1320 F. The metal filled mold is transferred to the solidification chamber and door closed. The vessel is pressurized to 90 psi with nitrogen, after which polyalkalene glycol cooling liquid at 100 F is pumped into the chamber, immersing the mold (Run B). Superheat from the cast mold moves into the cooling fluid resulting in rapid solidification of the casting. The casting is removed from the chamber, cleaned, and heat treated to optimal mechanical properties. A second mold is processed as above (Run A), but the process of quenching is performed under ambient atmospheric pressure. Pressure solidification has the added benefit of preventing gas porosity from nucleating in the solidifying casting.

| | Applicant's Process Run A | Applicant's Process Run B |
|---|---|---|
| Cooling Media | PAG Glycol | PAG Glycol |
| Cast Dendrite Arm Spacing | 56 um. | 56 um. |
| Radiographic inspection of casting | Grade C-D | Grade B |
| Tensile (after heat treat) | 49,800 psi | 52,000 psi |
| Yield Strength (after heat treat) | 39,900 psi | 41,000 psi |
| Elongation (after heat treat) | 3.0% | 5.0% |

It will be understood that the above examples are only illustrative of the invention and that various modifications and embodiments can be made to the invention described herein without departing from the spirit and scope thereof.

What is claimed is:

1. A controlled investment casting solidification system comprising:

an investment casting mold having molten aluminum metal therein;

a cooling chamber including a perforated and rollable tray adapted to receive, support, and retain said investment casting mold in a stationary position within said cooling chamber;

means for introducing a pressurized gas into said cooling chamber;

means for introducing into said cooling chamber a coolant liquid medium and for filling said cooling chamber with said coolant liquid to thereby immerse said investment casting mold in said coolant liquid while said investment casting mold is stationary, wherein said investment casting mold is immersed in and is in direct contact with said coolant liquid; and means for removing said coolant liquid from said cooling chamber when desired.

2. The system of claim 1, wherein said chamber includes a rapid lock door.

3. The system of claim 1, wherein said system includes means for providing agitation to the coolant liquid, and means for controlling flow of coolant liquid into said chamber.

4. The system of claim 2, where said system includes means for providing agitation to the coolant liquid, and means for controlling flow of coolant liquid into said chamber.

5. The system of claim 1, wherein said chamber is a double walled chamber functioning as a fluid reservoir and a means of keeping the chamber walls cool.

6. The system of claim 2, wherein said chamber is a double walled chamber functioning as a fluid reservoir and a means of keeping the chamber walls cool.

7. The system of claim 3, wherein said chamber is a double walled chamber functioning as a fluid reservoir and a means of keeping the chamber walls cool.

8. The system of claim 4, wherein said chamber is a double walled chamber functioning as a fluid reservoir and a means of keeping the chamber walls cool.

* * * * *